United States Patent [19]

Klitsner et al.

[11] Patent Number: 5,064,399

[45] Date of Patent: Nov. 12, 1991

[54] PLAY SET

[75] Inventors: Daniel B. Klitsner, San Francisco; D'Miles E. Milsal, Sunol, both of Calif.

[73] Assignee: Discovery Toys, Inc., Martinez, Calif.

[21] Appl. No.: 546,300

[22] Filed: Jun. 29, 1990

[51] Int. Cl.[5] ..... A63H 13/10; A63H 29/00; A63H 33/08; A63H 33/06

[52] U.S. Cl. ..... 446/308; 446/118; 446/125; 446/430

[58] Field of Search ..... 446/308, 309, 69, 117, 446/118, 101, 125, 127, 128, 429, 430, 153, 156; 273/400, 405

[56] References Cited

U.S. PATENT DOCUMENTS

| | | | |
|---|---|---|---|
| 1,425,376 | 8/1922 | Ford | 273/405 X |
| 1,440,454 | 1/1923 | Ganthier | 446/309 |
| 1,648,199 | 11/1927 | Sargent | 446/101 |
| 1,765,644 | 6/1930 | Aukenthaler | 446/128 |
| 2,234,617 | 3/1941 | Beck et al. | 446/309 |
| 2,691,243 | 12/1954 | Rade | 51/67 |
| 2,883,764 | 4/1959 | Stephens | 446/118 |
| 3,445,114 | 5/1969 | Fernandez | 446/129 X |
| 3,664,670 | 5/1972 | Glass et al. | 446/308 X |
| 3,715,121 | 2/1973 | Renn et al. | 446/308 X |
| 4,529,385 | 7/1985 | Reiner et al. | 446/101 X |
| 4,874,342 | 10/1989 | Klitsner | 446/168 |

FOREIGN PATENT DOCUMENTS

| | | | |
|---|---|---|---|
| 1938565 | 2/1970 | Fed. Rep. of Germany | 446/101 |
| 1092032 | 4/1955 | France | 446/118 |
| 268193 | 8/1950 | Switzerland | 446/118 |
| 278019 | 1/1952 | Switzerland | 446/118 |
| 949280 | 2/1964 | United Kingdom | 446/118 |
| 2105205 | 3/1983 | United Kingdom | 446/308 |

OTHER PUBLICATIONS

*Discovery Toys Fall/Winter Catalog*, 1986, p. 7, "Stack & Pop", Item 154.

*Fisher Price Catalog*, 1989, pp. 27, "Giant Rock-A-Stack", Item 0740.

*International Playthings Catalog*, 1988, pp. 21, Item KC3330/4.

Advertisement for Block Builders, "Tub Blocks", 1987 Geoffrey Inc.

"Stack-N-Tumble", No. 2031, 1989 Unimax Catalog.

"Clown Bowling", No. 173,559, 1988 Spring-Summer Childcraft catalog.

"Building Rabbits", No. EDU-3, 1989-1990 edition of Constructive Playthings catalog.

"Chunky Blocks", No. 1203, Holiday 1988 catalog from Toys To Grow On.

Stacking Toys illustrated on p. 31 of Holiday 1988 catalog from Toys To Grow On.

"Waffle Blocks", No. LT-026, 1989-1990 edition of Constructive Playthings catalog.

*Primary Examiner*—David N. Muir

*Attorney, Agent, or Firm*—Townsend and Townsend

[57] ABSTRACT

A toy is provided with a catapult having a launching surface, a plurality of interlocking figures, similarly shaped and sized to be launched from the launching surface, and a wave-like undulating surface with which the interlocking figures also fit.

19 Claims, 4 Drawing Sheets

PLAY SET

BACKGROUND OF THE INVENTION

The present invention provides a playset which serves to develop visual, motor, spatial and causative conceptual skills for a child.

Playsets are often purchased for small children and serve both educational and amusement functions. Children develop visual, motor, spatial and conceptual skills in response to stimulating and interesting playthings. Without experience with appropriate and interesting toys, children may fail to learn essential skills at critical periods in development.

Thus, there exists a need for improved toys that are substantially educational, provide the stimulus for rapid cognitive and motor development, and are safe and economical. The present invention fulfills these and other needs.

SUMMARY OF THE INVENTION

In accordance with the present invention, a toy is provided with a catapult having a launching surface, a plurality of interlocking figures, similarly shaped and sized to be launched from the launching surface, and a wave-like undulating surface onto which the interlocking figures also fit.

Each of the similarly shaped interlocking figures has a torso and various appendages extending therefrom. For example, a head extends upward from the torso, arms extend upward from the torso and legs extend downward from the torso. Typically, the head and each arm define a region therebetween, and the legs also define a region therebetween. In preferred embodiments, these appendages are sized and positioned to engage an associated surface depicting alternating wave crests and troughs. In more preferred embodiments, the figures are also shaped such that appendages of a first interlocking figure are sized and positioned to fit within the regions defined by the appendages of a second interlocking figure. Usually the figures will be symmetric about various axes or planes.

Associated with the figures is a wave-like undulating surface depicting wave crests and troughs. The wave crests should be configured to interlock with the appendages of the figures, typically with the head, arms or legs.

A catapult is associated with the figures and undulating surface. The catapult is mounted on a base, which preferably also provides the wave-like undulating surface. Usually, the catapult has a representation of a walking surface leading to a launchboard. In association with diver-like figures, the playset depicts a diving and swimming theme.

In particular embodiments, an arm or leg of a first interlocking figure is sized and positioned to fit within regions defined by the head and an arm or by the legs of a second interlocking figure. The interlocking figures, catapult and wave-like surface are conveniently made of plastic or wood. The interlocking nature of the components promotes development of the ability to visualize and recognize spatial relationships. Motor skills are developed by the manipulations necessary to prepare the catapult for use, and causation is taught by the effectuation of the catapulting of the pieces. This plaything provides a novel and useful combination of features especially adapted for young children.

A further understanding of the nature and advantages of the invention may be realized by reference to the remaining portions of the specifications and the attached drawings.

DETAILED DESCRIPTION OF THE PREFERRED EMBODIMENT

The present invention provides a novel playset with features characteristic of a swimming and diving scene. Various figures are provided representing divers or swimmers. These figures are interlockable, usually with one another or with an undulating surface which depicts a rippled water surface. In a preferred embodiment, a catapult is provided to launch the diver figures into the air. The catapult is mounted on a base having a wave-like undulating surface, thereby contributing to the overall effect of depicting a diving and swimming theme.

Figure 1:
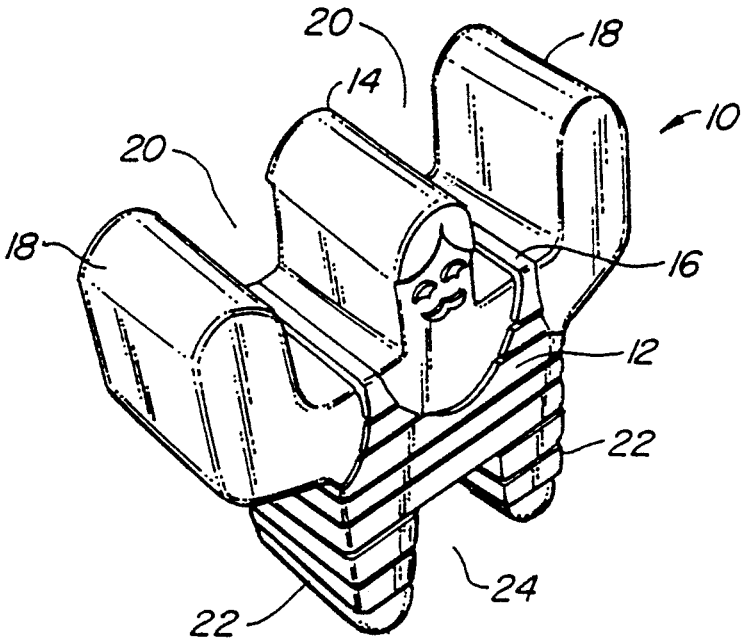
FIG. 1 illustrates an interlocking figure.

FIG. 1 illustrates an interlockable FIG. 10. The interlockable figure is a stylized depiction of a diver or a swimmer. Each interlockable figure 10 has a torso 12, a head 14 extending upwardly from the torso 12, and appendages, specifically arms 18 and legs 22, attached to the torso 12. The figure 10 depicts a symmetrical figure having arms 18 extending upward from the torso 12. Each arm 18 and the head 14 define first and second regions 20 between them. Legs 22 extend downward from the torso 12, the pair defining a third region 24.

Figure 2:
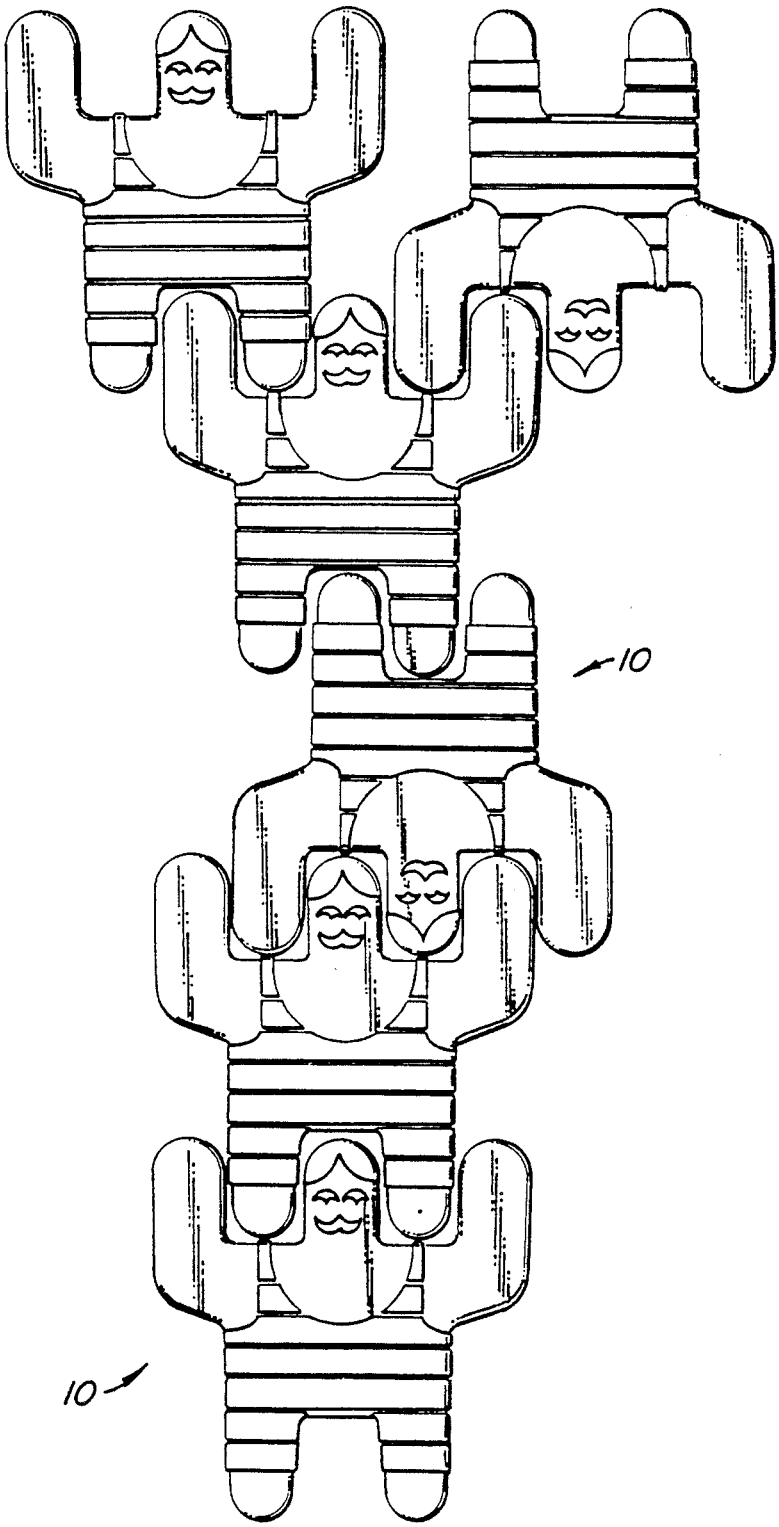
FIG. 2 illustrates a set of six interlocking figures and the various orientations allowing for the interlocking of shapes.

FIG. 2 depicts the interlocking arms 18, legs 22, and head 14 with regions 20, 24. Each leg 22 of a first figure 10 fit into regions 20 of a second figure. The head 14 and an arm 18 of a first figure fit into the first and second regions 20 of a second figure. The arm 18 of a first figure fits into first region 20 of a second figure. Additional interlocking positions include the fit of a leg 22 of a first figure into the third region 24 of a second figure. The arm of a first figure fits into the third region 24 of a second figure.

Figures 10 are symmetric both front to back and left to right. The interlockable FIGS. 10 may be made of a substantially rigid or flexible material, e.g., plastic, rubber, metal, or wood. The length and width of each appendage are kept uniform such that the regions defined will interchangeably fit either a head 14, an arm 18, or a leg 22.

Figure 3:
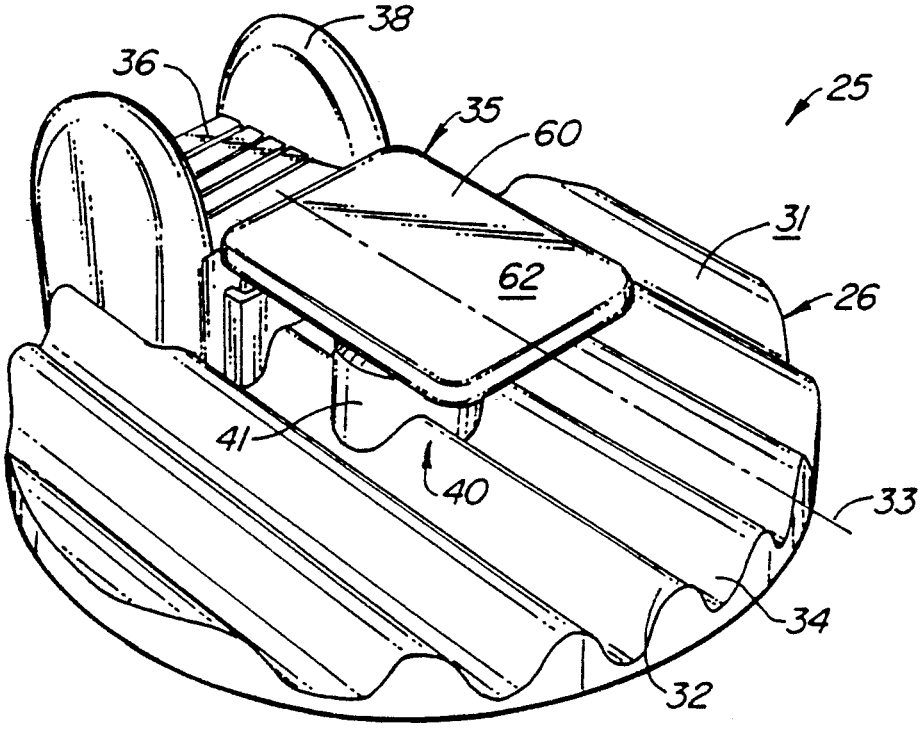
FIG. 3 illustrates a catapult assembly.

FIG. 3 illustrates one embodiment of a combination catapult and base 25. Base 26 has an undulating surface 31 which depicts waves. Wave crests 32 and troughs 34 are represented as the high and low regions of the undulating surface 31.

Combination 25 also includes a catapult 35 which includes a launchboard 60 stylized to represent a diving board with a launchboard surface 62. Upon this launchboard 60 is placed one or more of the diving figures 10 for catapult into the air. Catapult 35 includes a plunger assembly 40 mounted onto the base 30. Catapult 35 also includes a release button 36 detailed to represent a walking surface leading to the launchboard 60. Catapult 35 further includes upwardly extending rails 38 on either side of release button 36.

The crests 32 are parallel to the lengthwise axis 33 of the launchboard 60. However, the wave crests 32 can be oriented in a different direction. The depicted direction has the advantage that a figure 10, when facing the end 35 of the launchboard 60, faces in the same direction as when the figure interlocks with the wave crests 32 and troughs 34.

Figure 4:
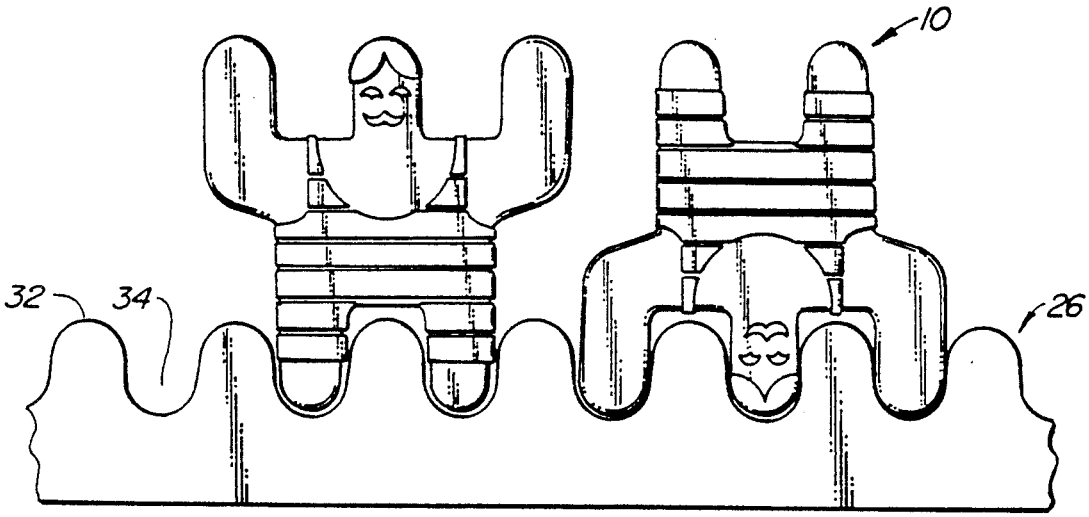
FIG. 4 illustrates the fit of interlocking figures with the wave crests and troughs of the catapult assembly.

FIG. 4 illustrates the relationship between the wave crests 32 and troughs 34 of the undulating surface 31 relative to the shape of the interlockable FIGS. 10. The crests 32 and troughs 34 are sized, shaped, and positioned so as to fit into the regions 20, 24 of the figures. The interlockable figures 10 may engage with the undulating surface 31 in addition to or concurrently with other interlockable figures.

Various forms of catapults may be used which function to catapult the interlockable FIGS. 10 into the air. Various forms of catapults are known and include spring-loaded catapults, electro-magnetic catapults, mechanical levers, and such. Typically, this play set is intended for use by very young children and will be designed in a manner consistent with child safety.

Figure 5:
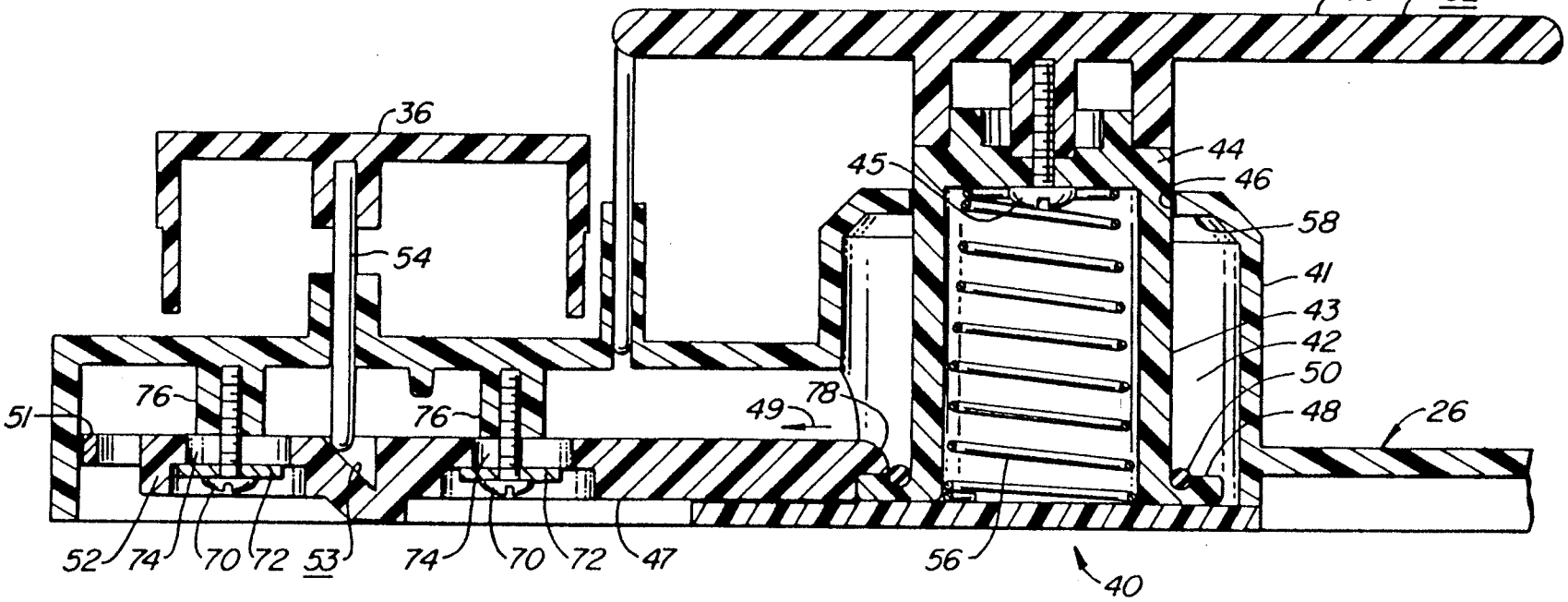
FIG. 5 illustrates a specific embodiment of a mechanism suitable for the catapult.

In one preferred embodiment, the plunger assembly 40 is designed as depicted in FIG. 5. Assembly 40 includes a hollow housing 41 having a hollow interior 42 within which a cup-shaped driver 43 is housed. The upper end 44 of driver 43 passes through an opening 46 in housing 41 and is secured to launchboard 60 by a screw 45. A coil compression spring 56 is housed within driver 43 and biases driver 43 upwardly through opening 46.

A movable catch 47 is used to engage a shoulder 48 of driver 43 to keep spring 56 depressed. Movement of catch 47 in the direction of arrow 49 releases driver 43 allowing spring 56 to drive driver 43 and launchboard 60 therewith upwardly to catapult any FIGS. 10 supported on surface 62. A rubber washer 50 is used to cushion the impact of shoulder 48 against opposed surface 58 of housing 41.

Catch 47 is biased toward driver 43 by a resilient spring clip extension 51 formed at the outer end 52 of catch 47. Catch 47 is guided by a pair of screws 70 and washers 72. Screws 70 pass through slots 74 formed in catch 47 and engage base 26 at bosses 76. The catch 47 further has an inclined surface 53 against which an extension 54 of the release button 36 is in contact. When the release button 36 is pushed down, extension 54 presses against the inclined surface 53 and pushes the catch 47 in the direction of arrow 49 to release the driver 43, allowing the compressed spring 56 to expand, push the launchboard 60 up and launch any figures 10 positioned upon the launchboard surface 62. Plunger assembly 40 is reset by pushing down on launchboard 60 which causes shoulder 48 to engage inclined surface 78 of catch 47 to momentarily drive catch 47 in the direction of arrow 49.

The present invention has both passive and interactive uses. Passively, a small child will find hours of enjoyment stacking the figures 10 upon one another in the endless combinations, as illustrated in FIG. 2. The figures 10 are fit onto the undulating surface 31, as illustrated in FIG. 4. As described above, figures placed on the undulating surface 31, as in FIG. 4, interlock with other figures, as in FIG. 2. In an interactive or dynamic mode, a small child will develop motor skills in the setting and release of the catapult 35. The child will be fascinated by the causation between the depressing of the release button 36 and the operation of the plunger assembly 40 and launchboard 60. The catapult 35 is set by pressing the launchboard downwards, thereby compressing the spring 43 and setting the plunger assembly 40 for release. The child will also learn that depressing the release button 36 causes the set launchboard 60 to spring upwards, thereby projecting figures 10 on the launchboard surface 62 upwards into the air in the manner that divers spring into the air. The child will recognize that interlocked figures 10 will be catapulted into the air, as are individual figures 10. The combination of all of the representations and actions which are associated together in a single play set will teach a young child many important skills.

Figure 6:
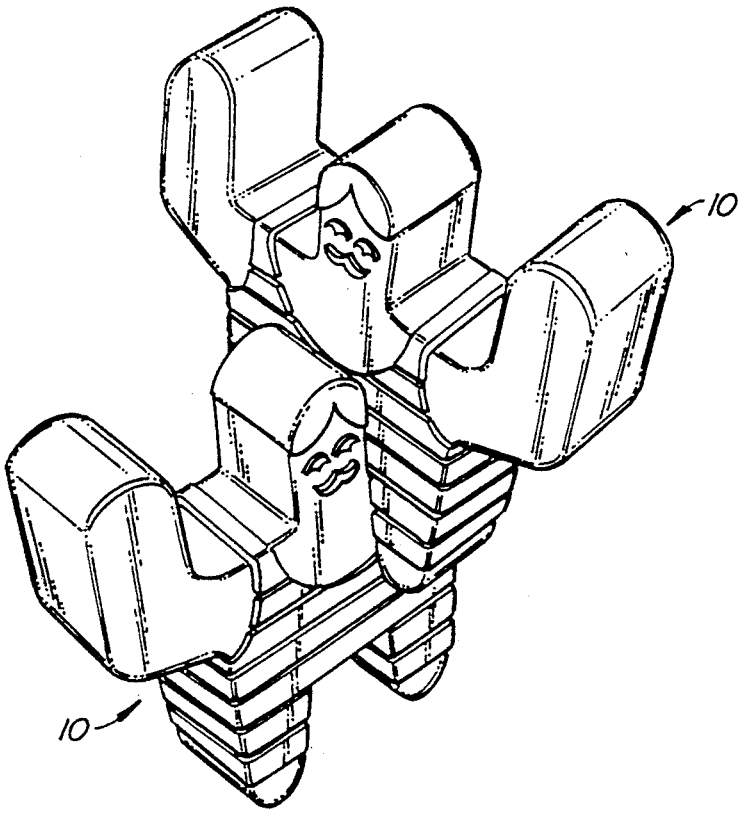
FIG. 6 illustrates an additional manner by which interlocking figures may fit together.

FIG. 6 further depicts another manner of interlocking the figures 10, where the thickness 66 of the figures is such as to allow the figures to fit in a transverse fashion. And, as the regions 20, 24 can be made identical in size, the inverted figures also interlock in a similar manner.

As discussed above, various different embodiments may be designed combining the features of the present invention. For example, a lever system to provide the launching force can be used. Various electro-magnetic mechanisms can be devised by one of ordinary skill in the art. Other spring-loaded catapult mechanisms may be used as well.

The described embodiment uses plunger assembly 40 to provide the force for catapulting the figures 10. The parts for constructing such a mechanism are well suited for molding from plastic. The base 30 upon which the undulating surface 31 is a part will typically be made of an easily shaped material, e.g., plastic, rubber, metal, or wood.

The figures 10 are typically rigid and stiff and are preferably made of plastic or wood. However, other materials are suitable where they retain the desired shape.

Although the present invention has been described in some detail by way of illustration and example for purposes of clarity of understanding, it will be obvious that certain changes and modifications may be practiced within the scope of the claims.

What is claimed is:

1. A toy comprising:

a base;

a catapult mounted on the base and having a launching surface;

a plurality of interlocking figures sized to be launched from said launching surface, said interlocking figures each including:

a torso;

a head extending upwardly from said torso;

first and second arms extending upwardly from said torso, said first and second arms and said head defining first and second regions therebetween; and first and second legs extending downward from said torso and defining a third region therebetween, wherein said first and second legs of a first said interlocking figure being sized and positioned to fit within said first and second regions of a second said interlocking figure sized to fit within said third region of first said interlocking figure so to permit said first interlocking figure to be supportable on said second interlocking figure; and said base having an undulated surface with wave crests, said adjacent wave crests defining troughs therebetween, said wave crests and troughs being sized and positioned to fit within at least one of said first and second regions and said third region of said interlocking figures.

2. A toy of claim 1, wherein said first arm of a first interlocking figure is sized and positioned to fit within said third region of a second interlocking figure.

3. A toy of claim 1, wherein said first arm and said head of a first interlocking figure are sized and positioned to fit within said first and second regions of a second interlocking figure.

4. A toy of claim 1, wherein said first leg of the first said interlocking figure is sized and positioned to fit within said third region of the second interlocking figure.

5. A toy of claim 1, wherein said first, second and third regions are each of a uniform size to fit any of said first and second arms, said head and said first and second legs.

6. A toy of claim 1, wherein said catapult has a representation of a walking surface leading thereto.

7. A toy of claim 1, wherein said catapult is a launchboard.

8. A toy of claim 1, wherein said wave crests are sized and positioned to fit within said third regions of said interlocking figures.

9. A toy of claim 8, wherein said wave crests are sized and positioned to fit within said first and second regions of said interlocking figures.

10. A toy of claim 1, wherein at least one of said head and said first and second arms of said interlocking figures are sized and positioned to fit within said troughs.

11. A toy of claim 1, wherein said interlocking figures are made of a material selected from the group consisting of plastic and wood.

12. A toy comprising:

a base including an undulated surface depicting waves, said waves defined by crests and troughs; and a plurality of interlocking figures, more than one of said interlocking figures each including:

a torso;

a head extending upwardly from said torso;

first and second arms extending upwardly from said torso, said first and second arms and said head defining first and second regions therebetween; and first and second legs extending downward from said torso and defining a third region therebetween, wherein said crests are sized and positioned to fit within at least one of said first, second and third regions, said troughs sized and positioned to engage at least one of said head, said arms and said legs.

13. A toy of claim 12, wherein said crests are sized and positioned to fit within said first and second regions of said interlocking figure.

14. A toy of claim 13, wherein said crests are sized and positioned to fit within said third regions of said interlocking figures.

15. A toy of claim 12, wherein said first arm of a first interlocking figure is sized and positioned to fit within said third region of a second interlocking figure.

16. A toy of claim 12, wherein said first arm and said head of a first interlocking figure are sized and positioned to fit within said first and second regions of a second interlocking figure.

17. A toy of claim 12, wherein said first leg of the first said interlocking figure is sized and positioned to fit within said third region of the second interlocking figure.

18. A toy of claim 12, wherein said first, second and third regions are each of a uniform size to fit any of said first and second arms, said head, said first leg, and second leg, and said crest.

19. A toy of claim 12 further comprising catapult means for launching said figure.

* * * * *